US008915684B2

(12) United States Patent
Adams

(10) Patent No.: US 8,915,684 B2
(45) Date of Patent: Dec. 23, 2014

(54) CARGO DECK

(75) Inventor: James H. Adams, Jasper, AL (US)

(73) Assignee: Fontaine Trailer Company, Inc., Haleyville, AL (US)

( * ) Notice: Subject to any disclaimer, the term of this patent is extended or adjusted under 35 U.S.C. 154(b) by 42 days.

(21) Appl. No.: 13/198,167

(22) Filed: Aug. 4, 2011

(65) Prior Publication Data

US 2011/0283924 A1 Nov. 24, 2011

Related U.S. Application Data

(63) Continuation-in-part of application No. 12/490,064, filed on Jun. 23, 2009, now Pat. No. 8,272,819, and a continuation-in-part of application No. 12/502,794, filed on Jul. 14, 2009, now abandoned, which is a continuation of application No. 11/235,757, filed on Sep. 27, 2005, now Pat. No. 7,571,953, application No. 13/198,167, which is a continuation-in-part of application No. 12/197,788, filed on Aug. 25, 2008, now Pat. No. 8,057,143, which is a continuation-in-part of application No. 11/235,757, filed on Sep. 27, 2005, now Pat. No. 7,571,953, application No. 13/198,167, which is a continuation-in-part of application No. 13/012,642, filed on Jan. 24, 2011, now abandoned, which is a continuation of application No. 12/502,816, filed on Jul. 14, 2009, now Pat. No. 7,896,427.

(51) Int. Cl.

| | |
|---|---|
| ***B60P 7/08*** | (2006.01) |
| ***B65D 90/00*** | (2006.01) |
| ***B65D 88/12*** | (2006.01) |
| ***B65D 88/52*** | (2006.01) |

(52) U.S. Cl.

CPC ..... *B65D 88/129* (2013.01); *B65D 90/006* (2013.01); *B65D 88/522* (2013.01)

USPC ..... 410/97; 410/104; 410/106; 410/110; 410/116

(58) Field of Classification Search

USPC ..... 410/97, 46, 77, 31, 34–35, 43, 56–57, 410/66, 71, 76

See application file for complete search history.

(56) References Cited

U.S. PATENT DOCUMENTS

| | | | |
|---|---|---|---|
| 2,447,471 | A | 8/1948 | Wagner |
| 2,639,187 | A | 5/1953 | Grumbache |

(Continued)

FOREIGN PATENT DOCUMENTS

| | | |
|---|---|---|
| EP | 0069043 | 1/1983 |
| EP | 1108608 | 6/2001 |

(Continued)

OTHER PUBLICATIONS

International Search Report and Written Opinion issued in corresponding International Application No. PCT/US2010/039515 issued Sep. 7, 2010.

(Continued)

*Primary Examiner* — Glenn Dayoan
*Assistant Examiner* — Sunsurraye Westbrook
(74) *Attorney, Agent, or Firm* — DLA Piper LLP (US); R. Blake Johnston

(57) ABSTRACT

A cargo deck includes a floor engageable with a load. The floor is formed from extruded aluminum in tubular panels extending transversely along the floor. Side rails are disposed on opposed sides of the deck. A plurality of longitudinally-extending support members support the floor, and are coupled to the floor via a plurality of support brackets extending angularly from the floor to the support members.

17 Claims, 15 Drawing Sheets

(56) References Cited

U.S. PATENT DOCUMENTS 2,735,377 A 2/1956 Elsner
3,102,646 A 9/1963 Deodat
3,125,354 A 3/1964 Connerat
3,185,519 A 5/1965 Turnbull et al.
3,252,730 A 5/1966 Chieger et al.
3,266,837 A 8/1966 Stricker, Jr. et al.
3,380,216 A 4/1968 Spence
3,422,508 A 1/1969 Higuchi
3,529,741 A 9/1970 Walker et al.
3,537,414 A 11/1970 Goldman
3,612,569 A * 10/1971 Marinelli ..... 280/423.1
3,620,388 A 11/1971 Mansson
3,620,505 A 11/1971 Murdock
3,622,114 A 11/1971 McIntire, Jr.
3,623,642 A 11/1971 Stephen
3,628,467 A 12/1971 Stout
3,633,937 A 1/1972 Hlinsky
3,648,909 A 3/1972 Wisecarver
3,664,273 A 5/1972 Howe
3,665,869 A 5/1972 Howe
3,705,732 A 12/1972 Marinelli
3,735,713 A * 5/1973 Glassmeyer ..... 108/53.5
3,770,186 A 11/1973 Kupersmit
3,774,364 A 11/1973 Johnson
3,794,375 A 2/1974 Woodward
3,850,113 A 11/1974 Sichak
3,909,059 A 9/1975 Benninger et al.
4,020,769 A 5/1977 Keir
4,049,229 A 9/1977 Peisner
4,049,285 A 9/1977 Chieger
4,067,601 A 1/1978 Tuerk
4,131,071 A 12/1978 Glassmeyer
4,138,950 A 2/1979 Mooney et al.
4,162,737 A 7/1979 Clive-Smith
4,167,273 A 9/1979 Hrasche
4,226,465 A 10/1980 McCullough
4,236,748 A 12/1980 Cloutier et al.
4,302,044 A 11/1981 Sims
4,319,732 A 3/1982 Godfrey
4,339,047 A 7/1982 Johansson et al.
4,353,520 A 10/1982 Jansson
4,358,134 A 11/1982 Scully
4,416,484 A 11/1983 O'Neill
4,484,847 A 11/1984 Holmes
4,527,765 A 7/1985 Dorpmund et al.
4,535,896 A 8/1985 Evenson
4,564,233 A 1/1986 Booher
4,618,068 A 10/1986 Born
4,626,022 A 12/1986 Booher
4,630,746 A 12/1986 Fortenberry
4,638,744 A 1/1987 Clive-Smith
4,678,389 A 7/1987 Bonerb
4,785,957 A 11/1988 Beck et al.
4,787,669 A 11/1988 Wante
4,789,197 A 12/1988 Lewis
4,796,539 A 1/1989 Berrett
4,818,162 A * 4/1989 Zukowski et al. ..... 410/116
4,838,605 A 6/1989 Abromavage
4,919,263 A 4/1990 Baltzer et al.
4,936,724 A 6/1990 Dutton
4,946,214 A 8/1990 Neumann et al.
4,954,031 A 9/1990 Geeck, III
4,966,085 A 10/1990 Howe
5,169,011 A 12/1992 Ebeling et al.
5,224,321 A 7/1993 Fearn
5,275,301 A 1/1994 Clive-Smith
5,320,396 A 6/1994 Petelka
5,338,084 A 8/1994 Wardell
5,351,990 A 10/1994 Thomas
5,388,938 A 2/1995 Helton
5,415,311 A 5/1995 Coogan
5,415,505 A 5/1995 Halpin et al.
5,416,956 A 5/1995 Rubin
5,417,453 A 5/1995 VanDenberg
5,449,082 A 9/1995 Reynard
5,474,331 A 12/1995 Booher
5,476,348 A 12/1995 Shelleby
5,494,182 A 2/1996 Clive-Smith
5,507,608 A 4/1996 Forslind
5,526,622 A 6/1996 Augustine
5,628,596 A 5/1997 Halpin et al.
5,639,174 A 6/1997 Gonska
5,644,992 A 7/1997 Clive-Smith
5,674,033 A * 10/1997 Ruegg ..... 410/104
5,678,715 A 10/1997 Sjostedt et al.
5,720,228 A 2/1998 Clive-Smith
5,755,472 A 5/1998 Clive-Smith
5,788,437 A 8/1998 Kalis, Jr.
5,791,579 A 8/1998 Raphael et al.
5,807,045 A 9/1998 Profit
5,810,186 A 9/1998 Lam
5,827,023 A 10/1998 Stull
5,860,777 A 1/1999 Walsh et al.
5,888,040 A 3/1999 Walsh et al.
5,890,757 A 4/1999 Masterson et al.
5,918,744 A 7/1999 Bringard et al.
5,938,059 A 8/1999 Luburic
5,941,398 A 8/1999 Harris
6,015,250 A 1/2000 Walsh et al.
6,112,929 A 9/2000 Ota
6,168,360 B1 * 1/2001 Knox ..... 410/96
6,174,023 B1 1/2001 Booher
6,182,411 B1 2/2001 Ganser et al.
6,250,861 B1 6/2001 Whitehead
6,256,844 B1 7/2001 Wheatley
6,279,763 B1 8/2001 Bush
6,283,538 B1 9/2001 Reitnouer
6,317,981 B1 11/2001 Clive-Smith
6,375,242 B1 4/2002 Zingerman
6,439,814 B1 8/2002 Floe
6,513,297 B2 2/2003 Kloepfer
6,513,442 B1 2/2003 Miller et al.
6,514,021 B2 2/2003 Delay
6,527,487 B2 * 3/2003 Adams ..... 410/104
6,572,325 B2 6/2003 Kelly
6,626,621 B1 9/2003 Hugg
6,626,623 B2 9/2003 DeLay
6,669,271 B2 12/2003 Booher
6,709,208 B1 3/2004 Lyrstrand et al.
6,709,209 B2 3/2004 Zhan et al.
6,712,568 B2 3/2004 Snyder et al.
6,783,312 B2 8/2004 Smith
6,846,140 B2 1/2005 Anderson et al.
6,866,160 B2 3/2005 Wang et al.
6,871,904 B2 3/2005 Bhat et al.
6,893,076 B1 5/2005 Lewis
6,918,721 B2 7/2005 Venton-Walters et al.
6,939,095 B1 9/2005 Hugg
6,948,895 B2 9/2005 Buff
6,960,055 B2 11/2005 Musso et al.
6,984,095 B2 1/2006 Johnson
7,011,479 B2 * 3/2006 Sain ..... 410/46
7,044,065 B2 5/2006 Arai et al.
7,051,410 B2 5/2006 Simond
7,056,073 B2 6/2006 Ardo
7,070,374 B2 7/2006 Womack et al.
7,090,449 B1 8/2006 Hugg
7,140,821 B2 11/2006 Sain
7,157,377 B2 1/2007 Garza et al.
7,160,069 B2 1/2007 Adams
7,172,378 B1 2/2007 Cerullo et al.
7,175,377 B2 2/2007 Womack et al.
7,267,393 B2 9/2007 Booher
7,401,844 B2 7/2008 Lemmons
7,416,167 B1 8/2008 Knox
7,458,758 B2 12/2008 Adams
7,491,024 B2 2/2009 Heinrichs et al.
7,568,754 B2 8/2009 Adams
7,571,953 B2 8/2009 Adams
7,735,891 B2 6/2010 Goode
7,739,965 B2 6/2010 Heinrichs et al.
7,802,526 B2 9/2010 Brady et al.
7,823,739 B2 11/2010 Sadkin et al.
7,931,164 B2 4/2011 Krohn

(56) References Cited

U.S. PATENT DOCUMENTS

| | | | | |
|---|---|---|---|---|
| 7,984,819 | B1 | 7/2011 | Davis | |
| 8,002,134 | B2 | 8/2011 | Whyte | |
| 8,196,766 | B2 | 6/2012 | Schrayvogel | |
| 8,210,374 | B2 | 7/2012 | Harpole | |
| 8,240,496 | B2 | 8/2012 | Kong et al. | |
| 8,286,562 | B2 | 10/2012 | Reynard | |
| 8,342,784 | B2 | 1/2013 | Crane et al. | |
| 8,347,560 | B2 | 1/2013 | Gyory et al. | |
| 2002/0012576 | A1 | 1/2002 | Anderson | |
| 2002/0025237 | A1 | 2/2002 | Adams | |
| 2003/0210966 | A1 | 11/2003 | Haire | |
| 2004/0007864 | A1 | 1/2004 | Adams | |
| 2004/0009049 | A1 | 1/2004 | Booher | |
| 2004/0028497 | A1 | 2/2004 | Wheatley | |
| 2004/0135398 | A1 * | 7/2004 | Booher | 296/182.1 |
| 2004/0222219 | A1 | 11/2004 | Taylor | |
| 2004/0232146 | A1 | 11/2004 | Kessler et al. | |
| 2004/0258498 | A1 * | 12/2004 | Bruns | 410/115 |
| 2006/0071506 | A1 | 4/2006 | Adams | |
| 2007/0007759 | A1 | 1/2007 | Lemmons | |
| 2007/0110537 | A1 | 5/2007 | Adams | |
| 2007/0206999 | A1 | 9/2007 | Clive-Smith | |
| 2008/0210687 | A1 | 9/2008 | Clive-Smith | |
| 2009/0028658 | A1 | 1/2009 | Adams | |
| 2009/0273204 | A1 | 11/2009 | Adams | |
| 2010/0122981 | A1 | 5/2010 | Sims | |
| 2010/0135742 | A1 | 6/2010 | Sain | |
| 2010/0140277 | A1 | 6/2010 | Clive-Smith | |
| 2010/0294785 | A1 | 11/2010 | Massa | |
| 2011/0024435 | A1 | 2/2011 | MacNabb | |
| 2011/0073595 | A1 | 3/2011 | Crane | |
| 2011/0155025 | A1 | 6/2011 | Reynard | |
| 2012/0048846 | A1 | 3/2012 | Choi | |
| 2012/0076605 | A1 | 3/2012 | Crane et al. | |

FOREIGN PATENT DOCUMENTS

| | | |
|---|---|---|
| EP | 1127009 | 5/2005 |
| EP | 1326791 | 7/2006 |
| FR | 2811252 | 1/2012 |
| GB | 1258284 | 12/1971 |
| GB | 2097364 | 11/1982 |
| GB | 2244090 | 11/1991 |
| GB | 2261259 | 5/1993 |
| GB | 2303360 | 2/1997 |
| GB | 2350862 | 12/2000 |
| GB | 2353275 | 2/2001 |
| GB | 2355451 | 4/2001 |
| GB | 2361961 | 11/2001 |
| GB | 2376014 | 12/2002 |
| GB | 2393435 | 3/2004 |
| JP | H59-134177 | 8/1984 |
| JP | H60-90190 | 6/1985 |
| WO | WO 95/12536 | 5/1995 |
| WO | WO 98/09889 | 3/1998 |
| WO | WO 01/98181 | 12/2001 |
| WO | WO 02/057113 | 7/2002 |
| WO | WO 03/010051 | 2/2003 |
| WO | WO 2005/066045 | 7/2005 |
| WO | WO 2006/005920 | 1/2006 |
| WO | WO 2007/071942 | 6/2007 |
| WO | WO 2009/064178 | 5/2009 |
| WO | WO 2009/106521 | 9/2009 |
| WO | WO 2010/041222 | 4/2010 |

OTHER PUBLICATIONS web.archive.org/web/20100317011105/http://www.cargomar.it/index.php/en/page/container s/4/1, Feb. 8, 2013.

web.archive.org/web/20100304052241/http://www.globalindustrial.com/g/storage/bins-totes-containers/folding/plastic-folding-bulk-containers, Feb. 8, 2013.

48ft Domino Type (13) lightweight intermodal, Domino Collapsible Flatrack, http://www.seabox.com/catdl/sb4/SB47138/SB47138.pdf, May 1, 2013.

45ft Domino Type (13) ISO/European/Intermodal use, Domino Flatracks, http://www.flatrackcontainers.com/product_info.asp?ProductID=Dom45_T13, Dec. 13, 2003.

S. Luna, "Intermodal Flat Rack Test", Transportation Technology Center, Inc., pp. 1-9, Jan. 14, 2010.

40ft Type 4, 40ft Domino Type (4) with flush folding endwalls, http://www.seabox.com/catdl/sb4/SB4744/SB4744.pdf, Apr. 30, 2013.

Flat Rack Collapsiblecontainers, East & West Express, http://www.ewexpress.com/serv/flatrackcolable.html, Jul. 10, 2014.

"Container Specification", Hapag-Lloyd, http://www.hapag-lloyd.com/downloads/press_and_media/publications/Brochure_Container_Specification_en.pdf, pp. 1-48, Apr. 30, 2013.

K. Priyo, "Containing Space -Four in a Box", LOG.indian, pp. 36-38, Jun. 30, 2008.

R. Konings et al. "Foldable Containers: a New Perspective on Reducing Container-Repositioning Costs Technological logistic and economic issues", EJTIR, 1, No. 4 (2001), pp. 333-352.

Domino Flatracks, http://web.arehive.org/web/200501262839/http://flatrackcontainers.com/, Feb. 25, 2014.

Cargoshell Takes a bow Container and swap-doby leasing, Container manuf . . . , http://www.woridcaraonews.com/htm/w20090731.494733.htm, Feb. 20, 2014.

A. Branch, "Export Practice and Management", Fifth Edition; Thomson Learning; 2006, pp. 85-86, 88, 92.

Anonymous, "Sole's Newest Corporate Member . . . " Logistics Spectrum; Jul.-Sep. 2006; 40, 3; ProQuest Research Library, pp. 36.

Flat Rack and Flatbed Container Photo Gallery, Feb. 20, 2014, http://www.rnatts-place.com/intermodal, Feb. 20, 2014.

2009 TAL International Container Corporation, Equipment Page, www.talinternationa.com, Feb. 20, 2014.

ISO Shipping Containers, Refrigerated, Storage & Cargo Containers, Feb., 20, 2014. http://seabox,com/, Feb. 20, 2014.

English Translation of FR2811252 published Jan. 11, 2002.

English Translation of EP 0069043 published Jan. 5, 1983.

Petition for Inter Parties Review of U.S. Patent No. 8,342,784 Under 35 U.S.C. §§ Under 35 U.S.C. §§ 311-319 and 37 C.F.R. §§ 42.1-.80, 42.100-.123; Case No. IPR2013-00360 filed on Jun. 14, 2013.

Exhibit 1007 from Case No. IPR2013-00360 filed Jun. 14, 2013.

Petition for Inter Parties Review of U.S. Patent No. 8,342,784 Under 35 U.S.C. §§ Under 35 U.S.C. §§ 311-319 and 37 C.F.R. §§ 42.1-.80, 42.100-.123; Case No. IPR2013-00361 filed on Jun. 14, 2013.

Exhibit 1014 from Case No. IPR2013-00361 filed Jun. 14, 2013.

International Search Report and Written Opinion form PCT/US2013/069448 issued on Apr. 4, 2014.

* cited by examiner

CARGO DECK

RELATED APPLICATIONS

This application is a continuation-in-part of and claims priority to the following U.S. Non-provisional patent applications:

1. U.S. Non-Provisional application Ser. No. 12/490,064, filed Jun. 23, 2009, titled "Restraining Strap Securement System," which is incorporated herein by reference.

2. U.S. Non-Provisional application Ser. No. 12/502,794, filed Jul. 14, 2009, titled "Trailer Flooring System," which is incorporated herein by reference. U.S. Non-Provisional application Ser. No. 12/502,794 is a continuation application and claims priority to U.S. Non-Provisional application Ser. No. 11/235,757, filed Jan. 4, 2007, and titled "Trailer," issued as U.S. Pat. No. 7,571,953. U.S. Non-Provisional application Ser. No. 11/235,757 claims priority to U.S. Provisional Application No. 60/616,029, filed Oct. 5, 2004.

3. U.S. Non-Provisional application Ser. No. 12/197,788, filed Aug. 25, 2008, titled "Trailer Load Securement System," which is incorporated herein by reference. U.S. patent application Ser. No. 12/197,788 is a continuation-in-part application and claims priority to U.S. Non-Provisional application Ser. No. 11/235,757, filed Jan. 4, 2007, and titled "Trailer," issued as U.S. Pat. No. 7,571,953. U.S. Non-Provisional application Ser. No. 11/235,757 claims priority to U.S. Provisional Application No. 60/616,029, filed Oct. 5, 2004.

4. U.S. Non-Provisional application Ser. No. 13/012,642, filed Jan. 24, 2011, titled "Trailer Side Rail," which is incorporated herein by reference. U.S. Non-Provisional application Ser. No. 13/012,642 is a continuation application and claims priority to U.S. Non-Provisional application Ser. No. 12/502,816, filed Jun. 14, 2009, and titled "Trailer Side Rail," issued as U.S. Pat. No. 7,896,427. U.S. Non-Provisional application Ser. No. 12/502,816 is a continuation application and claims priority to U.S. Non-Provisional application Ser. No. 11/649,579, filed Jan. 4, 2007, and titled "Side Rail Structure," issued as U.S. Pat. No. 7,568,754.

BACKGROUND AND SUMMARY OF THE INVENTION

A light weight cargo deck includes a floor comprised of tubular extruded aluminum panels and side rails formed as one piece from extruded aluminum. The floor is supported by a plurality of longitudinal support members (i.e., main beams) in some embodiments.

A plurality of support posts rotatably affixed to the longitudinal support members extend upwardly from the deck and may be used by overhead cranes to lift the cargo deck. The support posts are rotatable to a stowed position such that multiple cargo decks may be stacked when unloaded.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
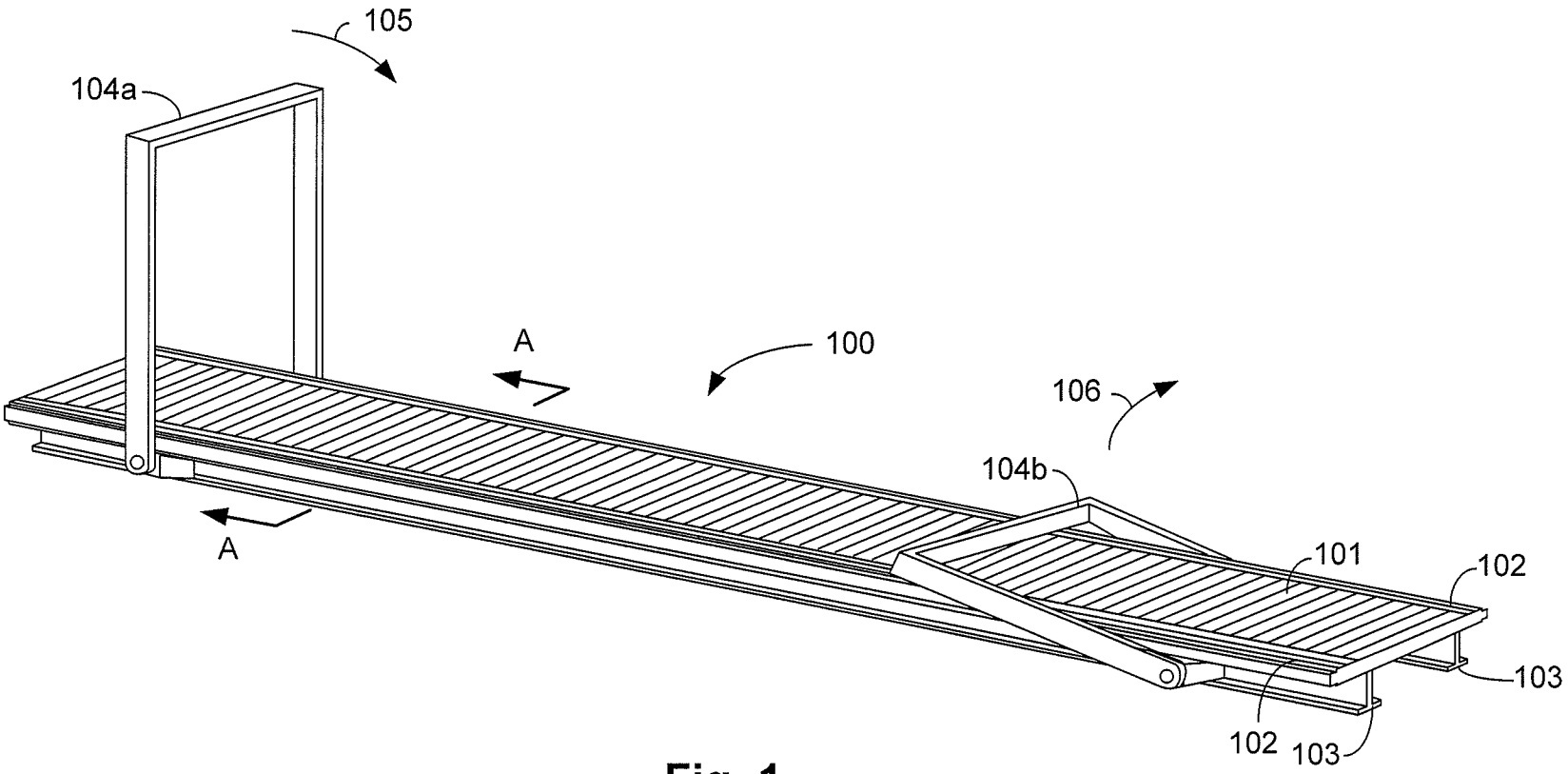
FIG. 1 is a side perspective view of a cargo deck according to an embodiment of the present disclosure.

FIG. 1 is a side perspective view of a cargo deck 100 according to an exemplary embodiment of the present disclosure. The cargo deck 100 comprises a floor 101 that is generally rectangular in the illustrated embodiment. The floor 101 is supported by longitudinally-extending support members 103, which extend generally parallel to each other and longitudinally along the length of the cargo deck 100. The support members 103 are generally "T"-shaped in the illustrated embodiment, as further discussed herein.

Support posts 104*a* and 104*b* are rotatably affixed to the longitudinally-extending support members 103. The support post 104*a* is shown in a "deployed" position in which the support post 104*a* is generally perpendicular to the floor 101. The support post 104*a* is rotatable in the direction shown by directional arrow 105 to "fold down" towards the floor 101

(i.e., in the manner as illustrated by support post 104*b*) so that multiple cargo decks 100 may be stacked on top of one another.

The support post 104*b* is shown in a "stowed" position in which the support post 104*b* is rotated downward towards the floor 101. The support post 104*b* is rotatable in the direction shown by directional arrow 106 to "fold up" such that the support post 104*b* is generally perpendicular to the floor 101 (i.e., in the manner as illustrated by support post 104*a*). The support posts 104*a* and 104*b* may be "locked" in either the stowed or deployed position during operation of the cargo deck 100.

Side rails 102 are disposed along opposed long sides of the cargo deck 100. The side rails 102 are formed from extruded aluminum in the illustrated embodiment. The floor 101 is comprised of a plurality of tubular extruded aluminum floor panels, as further discussed herein.

Figure 2:
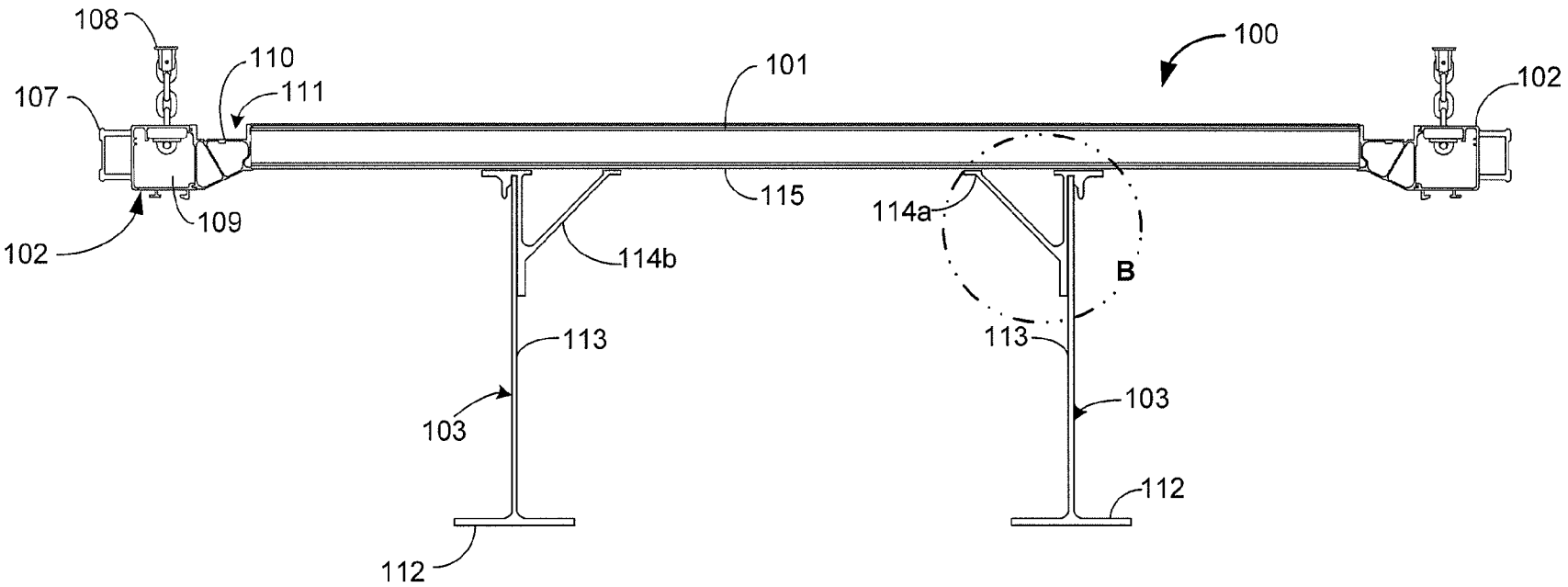
FIG. 2 is a partial cross-sectional view of the cargo deck of FIG. 1, taken along section lines A-A of FIG. 1.

FIG. 2 is a partial cross sectional representation of the cargo deck 100, taken along section "A-A" of FIG. 1. The floor 101 is generally horizontal, and is comprised of extruded aluminum panels, as further discussed herein.

The cargo deck 100 further comprises side rails 102, which are disposed on opposed side edges of the cargo deck 100. Each side rail 102 is substantially identical to, and a mirror image of, the other. The side rail 102 comprises a rub rail 107 that projects outwardly and protects the cargo deck 100 and a load (not shown) that may be on the cargo deck 100 from damage from collisions with objects (not shown).

Chain segments 108 are extendable from the side rail 102 intermittently along the side rail 102. The chain segments 108 are extended when in a "deployed" position during use of the chain segments 108 to secure cargo (not shown), and retractable into the side rail 102 in a "secured" position when not in use. In this regard, the side rail 102 comprises a hollow channel 109 into which the chain segments are retractable.

A nailer extender 110 is disposed between the floor 101 and the side rail 102 in the illustrated embodiment. The nailer extender 110 is a one-piece aluminum extrusion in this embodiment, and comprises a channel 111 for receiving and retaining a wooden plank (not shown) that may be desired by a user (not shown) for using nails (not shown) to secure cargo. Other embodiments may not include a nailer extender 110.

In the illustrated embodiment, the floor 101 is comprised from extruded aluminum panels (not shown) that are welded together, as further discussed herein. The floor 101 is rigidly affixed to the nailer extender 110 by welding, in this embodiment. The nailer extender 110 is rigidly affixed to the side rail 102 by welding, in this embodiment.

The longitudinally-extending support members 103 each comprise a bottom flange 112 integrally formed as one piece with a web 113 in the illustrated embodiment such that the support members 103 form an inverted "T" shape. The web 113 is generally vertically disposed and is generally perpendicular to the bottom flange 112. In the illustrated embodiment, the support members 103 are formed from steel, though other suitably strong and rigid materials may be used in other embodiments. Because the support members 103 are formed from steel, they cannot be welded to the floor 101, which is formed from aluminum in this embodiment. A plurality of adapter brackets 114*a* and 114*b* are therefore welded to a lower surface 115 of the floor 101, and the brackets 114*a* and 114*b* receive the support members 103, as further discussed herein with respect to FIG. 3. Each bracket 114*a*, 114*b* extends along the lower surface 115 of the floor 101 and receives a support member 103 along the length of the bracket 114*a*, 114*b*.

Figure 3:
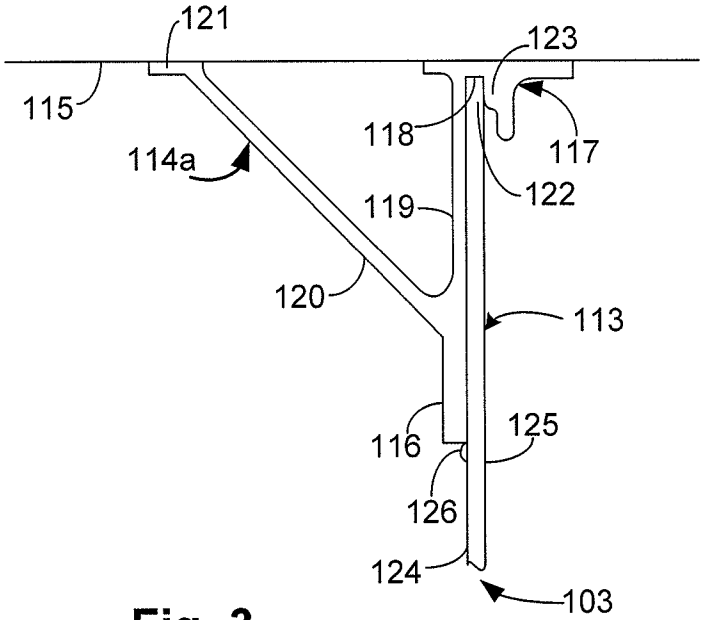
FIG. 3 is an enlarged sectional view of a portion of the cargo deck of FIG. 2, taken along detail line B of FIG. 2.

FIG. 3 is an enlarged detail view of the cross-section of the bracket 114*a* of FIG. 2, taken along detail line "B" of FIG. 2. The bracket 114*a* is formed from extruded aluminum in the illustrated embodiment. The bracket 114*a* has a general "Y" shape when viewed in cross section. A lower vertical support 116 extends generally vertically alongside the support member 103, and "branches" into an upper vertical support 119 and an angled support 120. The upper vertical support 119 extends generally vertically alongside the support member 103 upwards of the lower vertical support 116. The upper vertical support 119 terminates at an upper flange 117 which is rigidly affixed to the lower surface 115 of the floor 101, by welding in the illustrated embodiment. The upper flange 117 comprises a channel 118 that receives an upper edge 122 of the support member 103. In this embodiment, the support member 103 does not comprise a flange on its upper edge 122. Rather, the upper edge 122 is received by the channel 118 and is rigidly affixed to the bracket 114*a* via an adhesive (not shown).

In this regard, the web 113 of the support member 103 comprises an inward side 124 that is adhered to the bracket 114*a* via the adhesive. Adhesive is also applied in the channel 118 that receives the upper edge 122 of the support member 103. A protrusion 123 extends downwardly from the upper flange 117 and retains an outward side 125 of the web.

The angled support 120 terminates in an inward flange 121 which is rigidly affixed to the lower surface 115 of the floor 101, by welding in the illustrated embodiment. The inward flange 121 and the upper flange 117 are thus co-planar, as both are welded to the lower surface 115 of the floor 101, which is generally flat.

A protrusion 126 (comprised of a bead of steel weld, in the illustrated embodiment) extends from the inward side 124 of the web 113 at a lower end of the lower vertical support 116 to further brace the bracket 114*a* against the support member 103.

The bracket 114*b* is substantially similar to, and a mirror of, the bracket 114*a*. Some embodiments of the cargo deck 100 may not require longitudinally-extending support members 103 and thus may not require brackets 114*a*, 114*b*.

Figure 4:
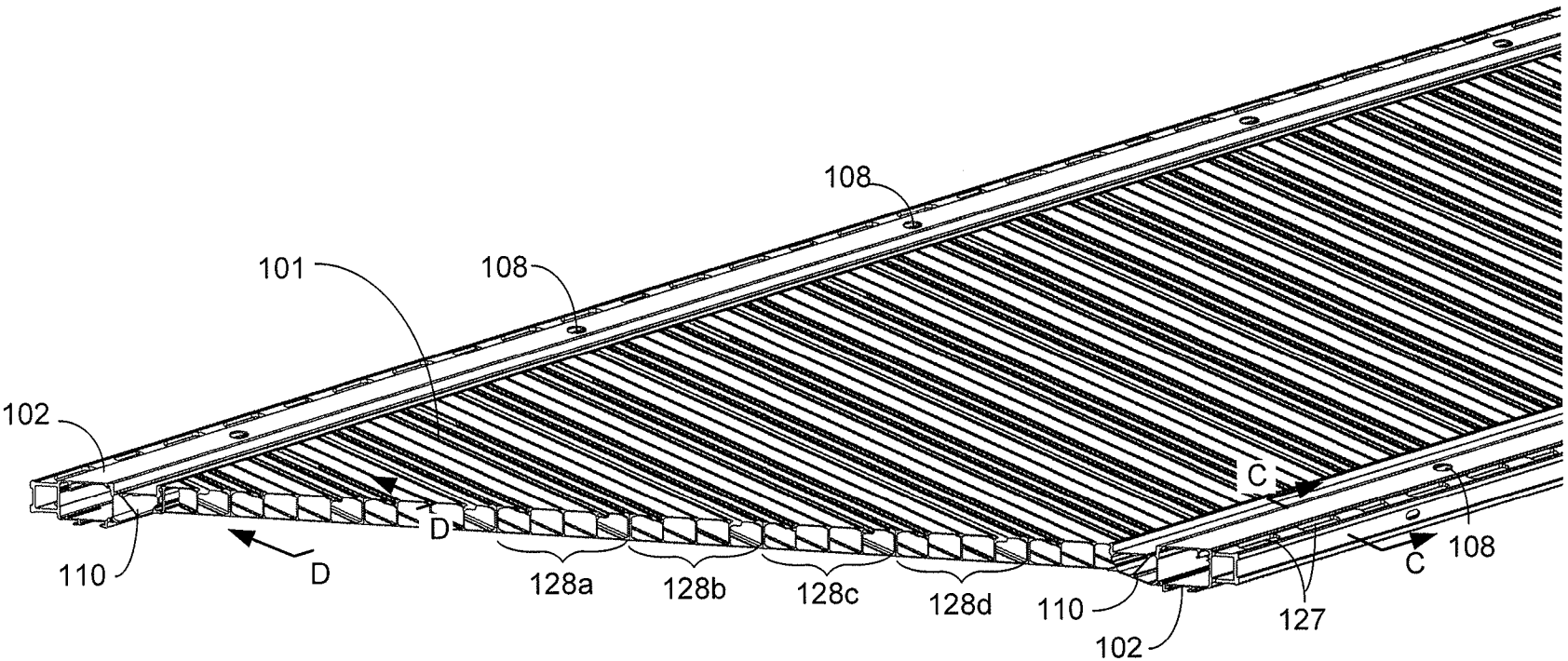
FIG. 4 is a perspective cut-away view of the floor and side rails of a cargo deck according to an embodiment of the present disclosures.

FIG. 4 is a cut-away perspective view of the floor 101, nailer extender 110, and side rails 102. The floor 101 is comprised of a plurality of tubular floor panels 128*a*, 128*b*, 128*c*, 128*d*, etc., connected together at their side edges to form a solid rectangular floor. The floor 101 may include any desired number of floor panels 128. The floor panels 128 may be connected to each other in any desired manner, and in the illustrated embodiment is shown connected by welding at a joint between the adjacent panels 128. The floor panels 128 may be made in any desired manner, such as extrusion. The floor panels 128 may be formed from aluminum or other suitable material, such as steel or other metal, or composite material, and in the illustrated embodiment is formed from extruded aluminum.

The tubular floor panels 128 extend transversely across the floor 101, i.e., generally perpendicularly to the longitudinal axis of the cargo deck 100. The floor 101 is rigidly affixed to the nailer extenders 110 at opposed edges of the floor 101, by welding in the illustrated embodiment. The nailer extenders 110 are rigidly affixed to the side rails 102, by welding in the illustrated embodiment.

A plurality of openings 127 extend through the rub rails 107 and may receive straps (not shown), for example, for securing cargo (not shown) during use of the cargo deck 100 (FIG. 1), as further discussed herein.

The chain segments 108 are illustrated in their stowed position, and are spaced-apart along the length of the side rail 102.

Figure 5:
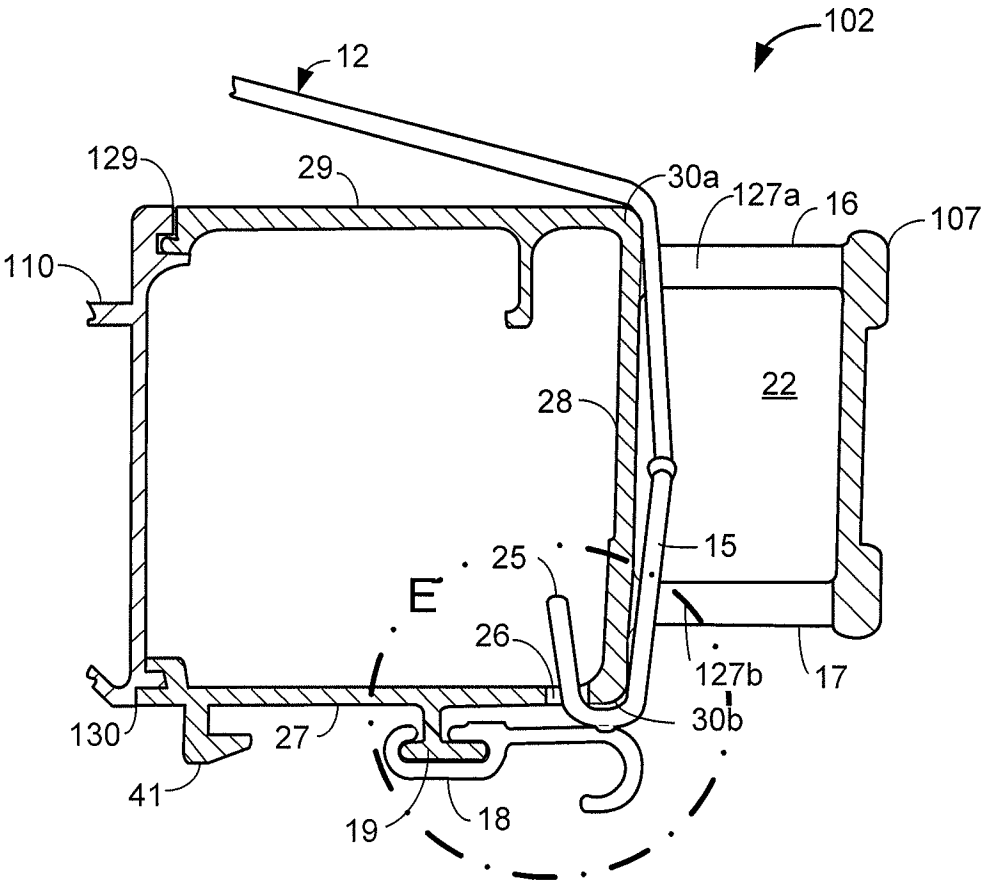
FIG. 5 is a sectional view of the side rail of FIG. 4, taken along sectional lines C-C of FIG. 4.

FIG. 5 is a cross-sectional view of the side rail 102, taken along section "C-C" of FIG. 4. The side rail 102 comprises a generally horizontal floor section 29 and an outer side rail wall 28 that extends downward from the floor section 29. The outer side rail wall 28 generally extends along the entire length of the cargo deck 100 (FIG. 1), except that the outer side rail wall 28 in places may be cut out to accommodate the support posts 104 of FIG. 1. The floor section 29 is coextensive with the outer side rail wall 28, and the outer side rail wall 28 extends generally perpendicular to the floor section 29, to form an inverted "L" shape in the illustrated embodiment. The intersection of the outer side rail wall 28 and the floor section 29 forms a rounded corner 30*a*.

Upper and lower connector walls 16 and 17 fix the rub rail 107 to the outer side rail wall 28. In this embodiment, the rub rail 107 is generally parallel to the outer side rail wall 28 and generally perpendicular to the upper and lower connector walls 16 and 17. The upper and lower connector walls 16 and 17 support the rub rail 107 spaced apart from the outer side rail wall 28 and create a substantially rectangular open space 22 that extends along the length of the side rail 102.

The upper and lower connector walls 16 and 17 extend generally parallel to each other. The upper wall 16 comprises a plurality of upper openings 127*a* and the lower wall 17 comprises a plurality of lower openings 127*b* that are generally aligned with the upper openings 127*a* in the upper wall 16. A strap 12 can thus pass through the upper opening 127*a* and the lower opening 127*b* in a generally straight vertical line. The strap 12 comprises flexible material which may conform to and secure cargo (not shown).

A lower side rail wall 27 extends generally perpendicularly from the outer side rail wall 28, forming a corner 30*b* where the outer side rail wall 28 meets the lower side rail wall 27. A hook opening 26 is formed in the lower side rail wall 27 near the corner 30*b*. The hook opening 26 is sized and shaped to receive and retain a flat hook 15 that is disposed on a free end of the strap 12. The flat hook 15 comprises a free end 25 that is received by the hook opening 26. In order to secure a load 11, a user (not shown) may pass the flat hook 15 through the openings 21 and 23 and then hook it over the corner 30*b* such that the free end 25 is within the hook opening 26. There must necessarily be slack in the flexible portion 24 of the strap 12 in order for this to be accomplished. The user then tightens the strap 12 by using a strap winch (not shown).

A keeper 18 restrains the flat hook 15 in position within the opening 26. The keeper 18 is slideably connected to a bottom rail 19 disposed on the lower side rail wall 27 of the side rail 102. After the flat hook 15 is in place, the keeper 18 may be slid along the rail 19 until it contacts the flat hook 15 to hold the flat hook 15 in place while the strap 12 is being tightened.

In some embodiments, an L-shaped track 41 is disposed on the lower side rail wall 27 and is substantially parallel to the bottom rail 19. The L-shaped track 41 and the bottom rail 19 may be used together to support a strap winch (not shown) that may be supported by a "Double-L track" that is known in the art. In other words, the bottom rail 19 may serve as the second "L" in a "Double-L track" pair that may support a strap winch.

The rub rail 107 is integrally formed with the outer side rail wall 28, by extrusion in the illustrated embodiment. The side rail 102 is rigidly affixed to the nailer adapter 110 at joints 129 and 130, by welding in this embodiment.

Figure 6:
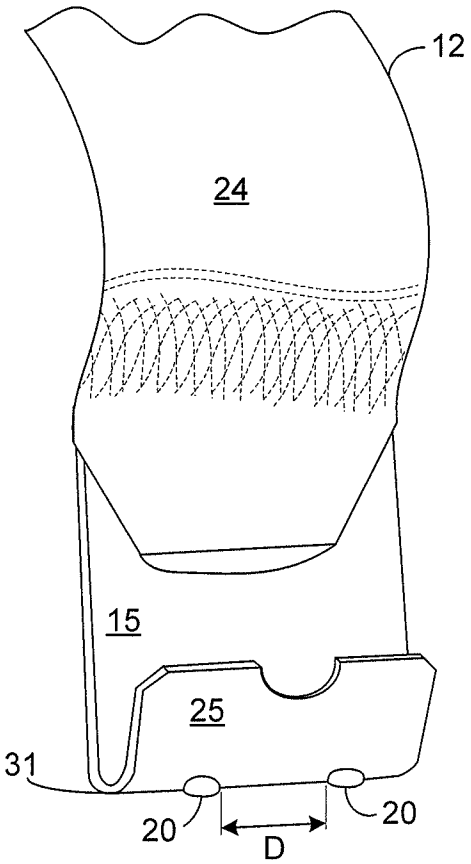
FIG. 6 depicts a perspective view of a flat hook used to secure a load.

FIG. 6 depicts a front perspective view of an embodiment of the strap 12 comprising the flat hook 15 and a flexible portion 24. Two protrusions 20 are disposed on the bottom exterior surface 31 of the flat hook 15. The protrusions 20 maintain the keeper 18 in proper position in contact with the flat hook 15, as further shown in FIG. 7.

Figure 7:
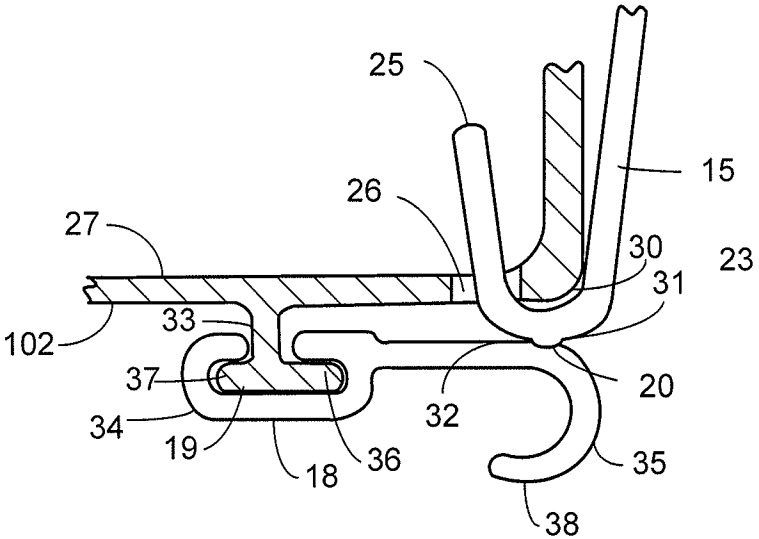
FIG. 7 depicts an enlarged detail view of the side rail portion shown in FIG. 5, taken along detail view "E" of FIG. 5.

FIG. 7 is an enlarged view of the cross-sectional view of the side rail 102 of FIG. 5, taken along detail line "E" of FIG. 5, depicting the keeper 18 restraining the flat hook 15. The bottom rail 19 is affixed to the lower side rail wall 27 by a standoff 33. The bottom rail 19 and the standoff 33 form a shape similar to an inverted letter "T." In the illustrated embodiment, the outermost leg 36 of the rail 19 is longer than the innermost leg 37 of the rail 19. The bottom rail 19 extends down the length of the side rail 102 (FIG. 4). In other embodiments, the bottom rail 19 may be in a different configuration, provided that the keeper 18 may be slideably coupled to the bottom rail 19.

In this embodiment, the keeper 18 comprises a generally C-shaped portion 34 and a generally J-shaped portion 35. The C-shaped portion 34 slideably mates with the bottom rail 19. The J-shaped portion 35 extends from the C-shaped portion 34 and has an inwardly-extending hook 38. The hook 38 may be used to secure tarps (not shown) or ropes that are covering a load.

An outer keeper surface 32 of the J-shaped portion 35 contacts the bottom exterior surface 31 of the flat hook 15. In other embodiments of the invention, the keeper 18 may be comprised of the C-shaped portion 34 that slideably mates with the bottom rail 19 and an extending flat-hook-contacting portion (not shown), and may not have a J-shaped portion 35. Further, shapes other than a C-shape may be used to slideably secure the keeper 18 to the rail 35.

The keeper 18, which may slide along the rail 19 unless restrained, is kept in place between the two protrusions 20 of the flat hook 15. Thus the keeper 18 keeps the flat hook 15 in position (i.e., keeps it from falling out of the opening 26) and the protrusions 20 on the flat hook 15 in turn maintain the keeper 18 in position along the rail 19. The width "W" (FIG. 8) of the outer keeper surface 32 of the keeper 18 must therefore be less than the distance "D" (FIG. 6) between the two protrusions 20 in order for the outer keeper surface 32 of the keeper 18 to fit in between the protrusions 20 and be restrained by them. This relationship is discussed further below with respect to FIG. 9.

Figure 8:
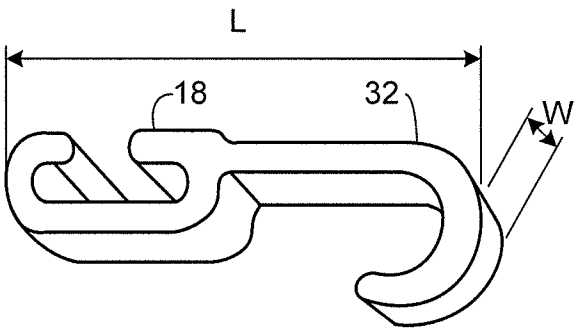
FIG. 8 depicts a perspective view of the keeper hook as shown in FIG. 7.

FIG. 8 is a side perspective view of the keeper 18. In this embodiment, the keeper 18 has width "W" and a length "L." The length "L" must be sufficient for the outer keeper surface 32 to contact the flat hook 15 (FIG. 5) when the keeper 18 is slideably positioned beneath the flat hook 15.

Figure 9:
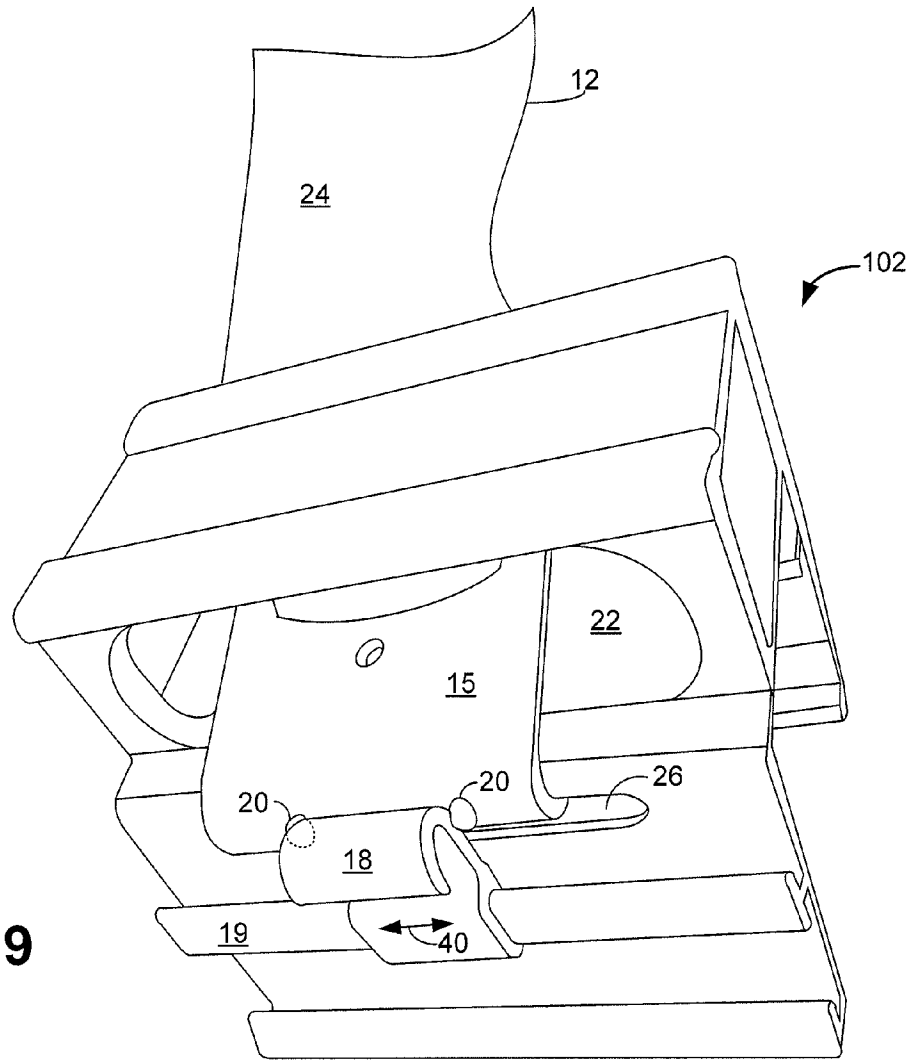
FIG. 9 depicts a partial bottom perspective view of the side rail shown in FIG. 5.

FIG. 9 is a bottom perspective view of a segment of the side rail 102 with the keeper 18 restraining the flat hook 15. The keeper 18 may slide on the bottom rail 19 in the direction as indicated by direction arrow 40, i.e., longitudinally along the side rail 102.

In operation, the user (not shown) feeds the flat hook 15 through the openings 127*a* (FIG. 5) and 127*b* (FIG. 5) and then hooks the flat hook 15 into the opening 26 on the lower side rail wall 27 of the side rail 102. The user then slides the keeper 18 along the bottom rail 19, and over one of the protrusions 20 until the keeper 18 is frictionally held between the two protrusions 20. There is sufficient clearance between the outer keeper surface 32 (FIG. 8) and the flat hook 15 (when the flat hook is held tightly against the corner 30*b* (FIG. 5), for example) for the keeper 18 to slide over one of the protrusions 20 and then be held in place between the two protrusions 20.

Figure 10:
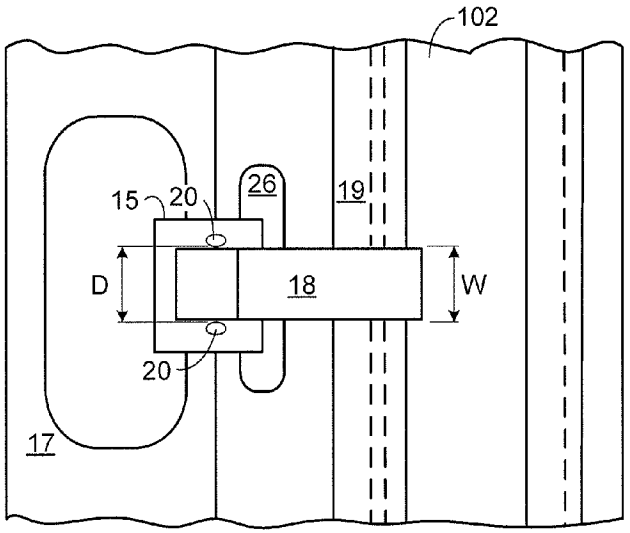
FIG. 10 depicts a partial bottom view of the side rail shown in FIG. 9.

FIG. 10 is a partial bottom view of the side rail 102 showing the keeper 18 restrained between the protrusions 20 on the flat hook 15. As discussed above, the width W of the keeper 18 must be less than the distance D between the two protrusions 20 in order for the keeper 18 to fit between the two protrusions 20.

Figure 11:
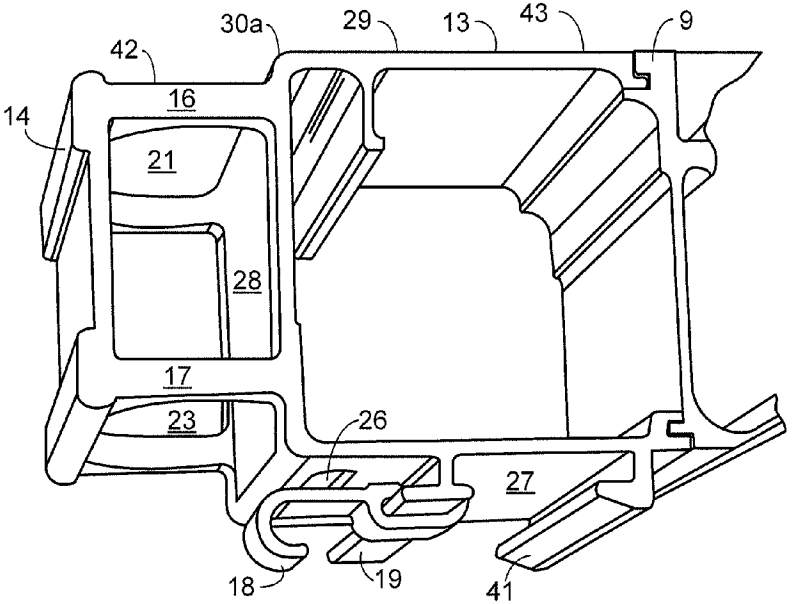
FIG. 11 is a side perspective view of the side rail portion shown in FIG. 5, without the strap and flat hook.

FIG. 11 depicts a partial side perspective view of a cross-section of the side rail 102 shown without a strap 12 (FIG. 5) or flat hook 15 (FIG. 5). In this embodiment, the top surface 42 of the upper connector wall 16 is lower than the top surface 43 of the floor section 29, forming the corner 30*a*. Further, the corner 30*a* between the floor section 29 and the outer side rail wall 28 is smooth and rounded to provide a smooth surface for the strap 12 (FIG. 5) to rest against.

Although the keeper 18 is illustrated herein as restraining the flat hook 15, in other embodiments the keeper 18 is used without the flat hook 15. In such embodiments, the keeper may be used to tie off a load (not shown).

Figure 12:
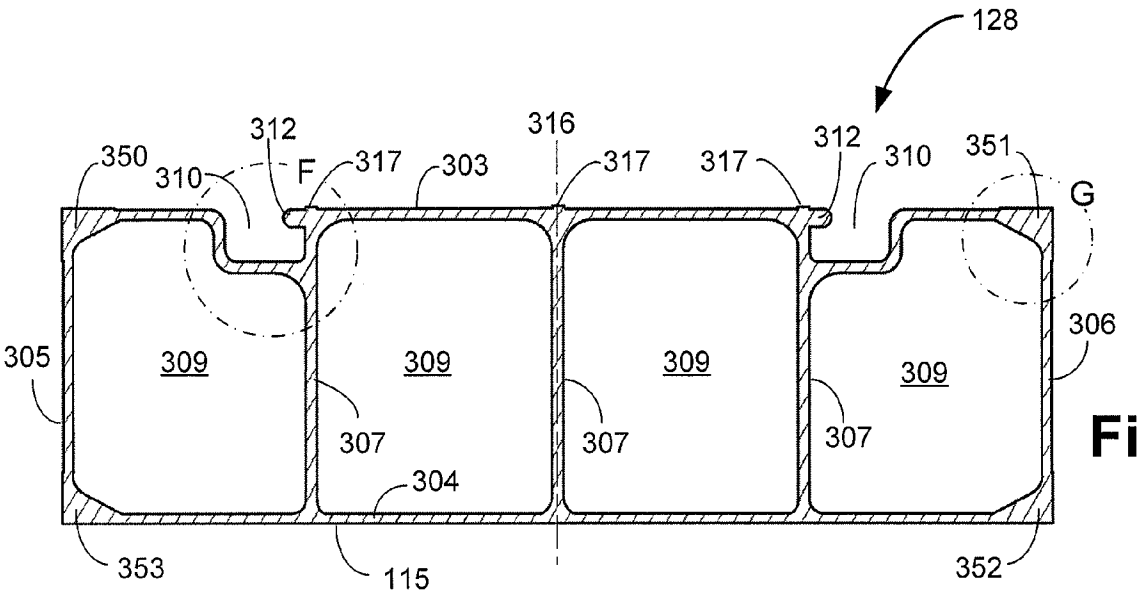
FIG. 12 is a cross-sectional view of a floor panel of FIG. 4, taken along section lines D-D of FIG. 4.

FIG. 12 is a cross-sectional view of a floor panel 128 of FIG. 4, taken along section lines "D-D" of FIG. 4. Each floor panel 128 is substantially similar; accordingly, only one floor panel 128 will be described in detail. The floor panel 128 includes an upper wall 303 and a lower wall 304. Side walls 305 and 306 extend generally perpendicular to the upper and lower walls 303 and 304. A load (not shown) may engage the upper wall 303. A lower surface 115 of the lower wall 304 may engage the support members 103 (FIG. 1). The side walls 305 and 306 engage side walls of adjacent floor panels 128.

A plurality of partitioning walls 307 (FIG. 12) extend generally perpendicularly to the upper and lower walls 303 and 304 and generally parallel to the side walls 305 and 306. The partitioning walls 307 define a plurality of tubular portions 309 integral to the floor panel 128 and extending longitudinally along the floor panel 128. Although three (3) partitioning walls 307 defining four (4) tubular portions 309 are shown in FIG. 12, it is contemplated that the floor panel 128 may have any desired number of partitioning walls 307 defining any desired number of tubular portions 309.

Figure 13:
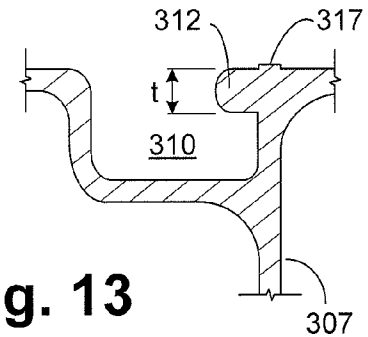
FIG. 13 is an enlarged detail view taken along detail line "F" of FIG. 12.

The upper wall 303 includes a pair of recessed channels 310 running generally parallel to a longitudinal axis of the floor panel 128, as further illustrated in FIG. 13. The pair of channels 310 may receive one or more sliding brackets 311 (FIG. 13). The sliding brackets 311 are slideably retained in the channels 310 by protrusions 312 that extend from the upper wall 303 into the channels 310.

Raised strips 317 in the upper wall 303 comprise thin raised strips running longitudinally down each floor panel 128. The raised strips 317 may provide traction for the load (not shown), as further discussed herein. The raised strips 317 also provide load-bearing surfaces directly above the partitioning walls 307, to increase the effective strength of the floor panel 128. Thus the raised strips 317 are located generally directly above the partitioning walls 307 in order to concentrate the weight of the load (not shown) on the strongest areas of the floor panel 128. In one embodiment, the raised strips 317 are 0.095" wide and are raised 0.020 above the surface of the upper wall, though other dimensions could be used in other embodiments.

In this embodiment, the floor panel 128 is symmetrical and mirror-imaged about a plane running longitudinally through its vertical axis, illustrated in two-dimensional representation as centerline 316. The protrusions 312 extend outwardly into the channels 310, thereby forming a somewhat L-shaped channel 310. In other embodiments of the cargo deck 100 (FIG. 1), there is no channel 310, because the sliding brackets 311 (FIG. 13) are not desired to be employed.

In one embodiment, the floor panel 128 is 3.125 inches thick by 9.749 inches wide; however, other dimensions are possible in other embodiments. The partitioning walls 307 provide strength to the floor panels 128, but the walls 307 are generally thin (0.095 wide in one embodiment). Therefore, most of the panel 128 interior is hollow. The strength lies thus in the "honeycomb" effect of the tubular portions 309, which enables a lightweight but strong floor.

The upper wall 303, the lower wall 304, and the sidewalls 305 and 306 are also generally thin (0.095 in one embodiment). The floor panel 128 moreover comprises four (4) outer corners: upper left corner 350, where sidewall 305 joins top wall 303; upper right corner 351, where sidewall 306 joins with top wall 303; lower right corner 352, where sidewall 306 joins with lower wall 304; and lower left corner 353, where sidewall 305 joins with lower wall 304. In one embodiment, the material in the corner regions is generally thicker than the walls 303, 304, 305, and 306, as illustrated in FIG. 14, to strengthen the floor panel 128.

FIG. 13 is an enlarged cross-sectional view of the channel 310 of FIG. 12, taken along detail line "F" of FIG. 12. The protrusion 312 is generally rounded on its outer edge and in one embodiment has a thickness "t" of 0.188 and a radius of 0.094. In one embodiment, the channel 310 is 0.75 wide and approximately ½" deep, and the protrusion 312 protrudes into the channel approximately 0.2 inches. As one with skill in the art knows, other dimensions may be utilized for the protrusions 312 and channel 310. The channel 310 is sized to receive the sliding bracket 311 (FIG. 15), and the protrusions 312 are sized to slideably retain the sliding bracket 311.

Figure 14:
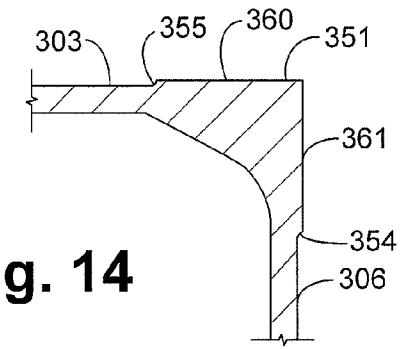
FIG. 14 is an enlarged detail view taken along detail line "G" of FIG. 12.

FIG. 14 is an enlarged cross-sectional view of the corner 351 of FIG. 12, taken along detail line "G" of FIG. 12. The side wall 306 is recessed from a generally vertical surface 361 of the upper right corner 351, i.e., the side wall 306 "steps down" from the vertical surface 361 at step 354. Although not clearly illustrated, each of the corners 350, 352 and 353 (FIG. 12) are similarly disposed, and the side wall 305 is also similarly recessed. The purpose of this recession is to ensure that the corners of adjacent panels are flush when welding, and that side walls 305 and 306 cannot bow out such that a protruding side wall prevents the corners from meeting. The sidewalls 305 and 306 are recessed by 0.020 in one embodiment, though other dimensions could be used in other embodiments.

Referring to 14, the upper wall 303 "steps up" to the horizontal surface 360 in the upper right corner 351 at step 355. The raised area in the corner 351 provides a thicker surface for the weld between adjacent floor panels 128. The horizontal surface 360 is raised above the upper wall 303 by 0.020 in one embodiment, though other dimensions could be used. The upper left corner 351 (FIG. 12) is similarly raised from the upper wall 303.

Figure 15:
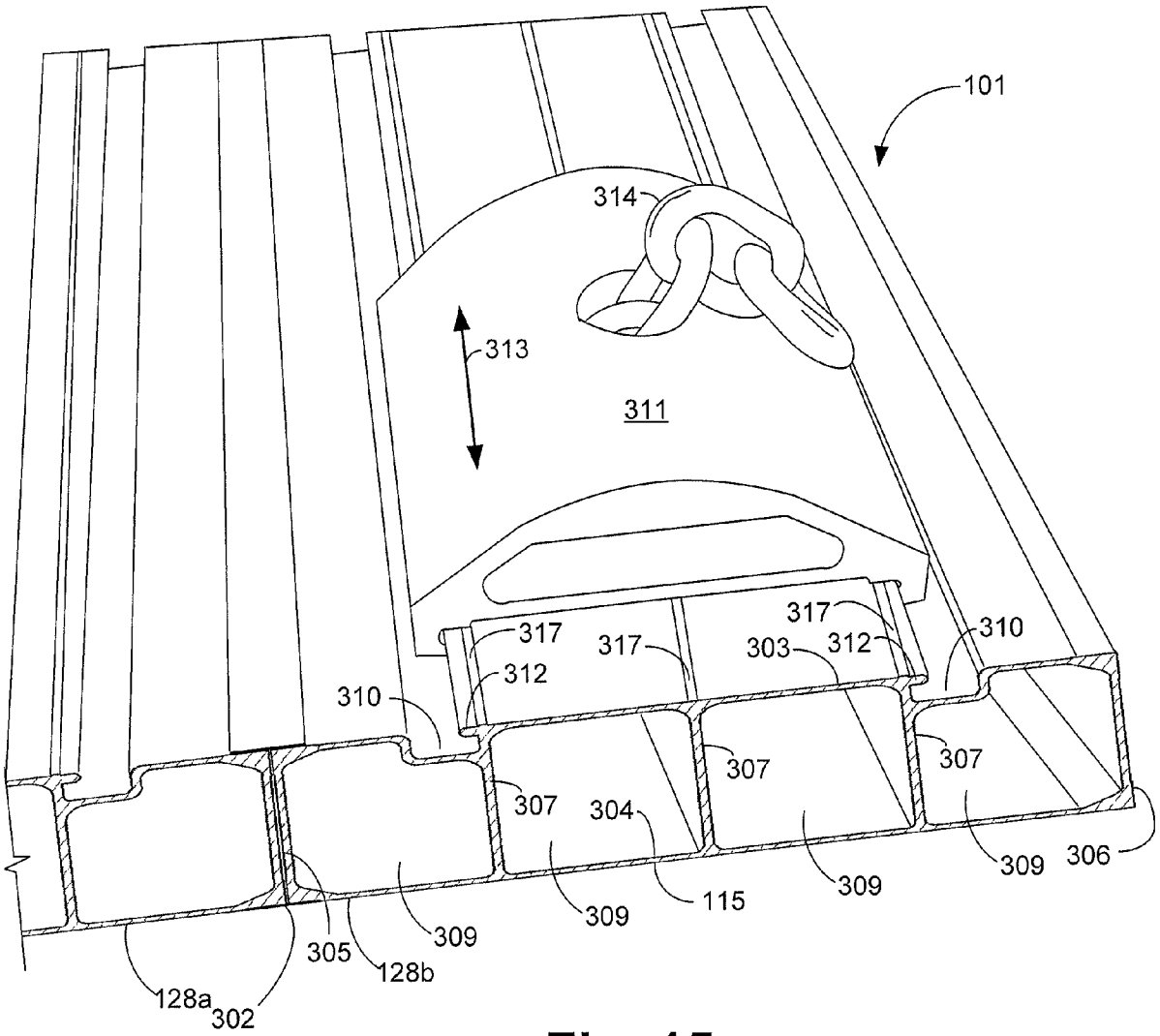
FIG. 15 is a cut-away perspective view of the floor with a sliding bracket according to an embodiment of the present disclosure.

FIG. 15 is a cut-away perspective view of the floor 101 showing adjacent floor panels 128*a* and 128*b* joined together at a joint 302 between the panels 128*a* and 128*b*. The floor panels may be connected to each other in any desired manner, and in the illustrated embodiment is connected by welding at the joint 302 between the adjacent panels 128*a* and 128*b*. A sliding bracket 311 is received by a pair of channels 310 and may slide within the channels 310 in a direction longitudinal to the floor panels 128, as indicated by directional arrow 313. Sliding brackets 311 are used in some embodiments to secure cargo (not shown) to the cargo deck 100 (FIG. 1).

The protrusions 312 help to retain the sliding bracket 311 within the channels 310. At the ends (not shown) of each floor panel 128, there may be no protrusions 312, to allow for installation of the sliding brackets 311 into the channels 310. For example, in one embodiment (not shown), the last six (6) inches of the pair of channels 310 does not have protrusions 312, enabling the sliding bracket to be "dropped" into the channel and slid in the direction of directional arrow 313 until the protrusions 312 engage with the sliding bracket 311 to retain the bracket 311.

A securement device 314, such as a chain illustrated in FIG. 15, extends from the sliding bracket 311 and attaches to chains or straps (not shown) that secure the load (not shown).

Figure 16:
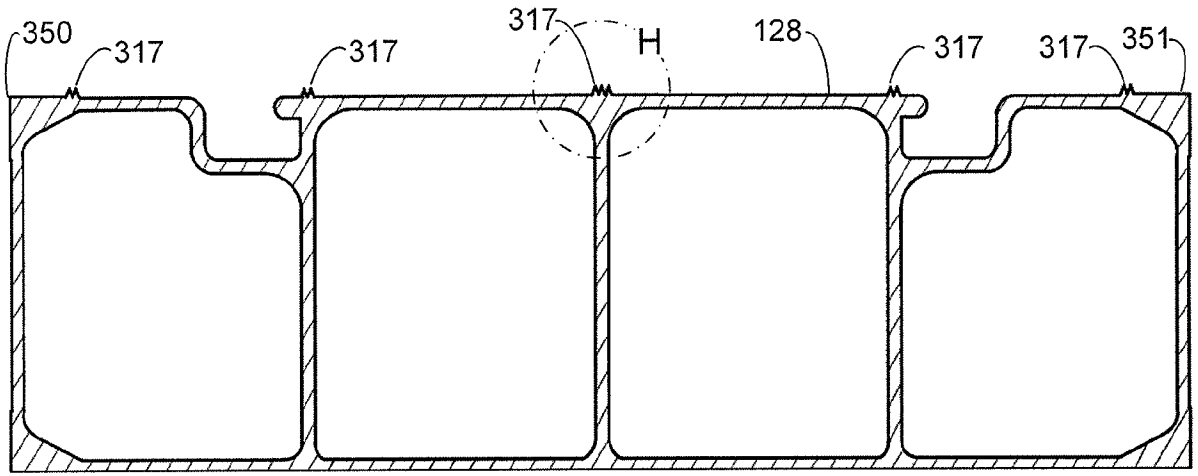
FIG. 16 is an alternative embodiment of the raised tracks as depicted in FIG. 12.

FIG. 16 illustrates an alternative embodiment of the floor panel 128 in which the raised strips 317 are comprised of a plurality of pointed protrusions 362 (FIG. 17) instead of the "smooth" raised strips illustrated in FIGS. 12 and 15. The pointed protrusions in the raised strips 317 may also be employed near the upper left and upper right corners, 350 and 351 respectively, for added traction.

Figure 17:
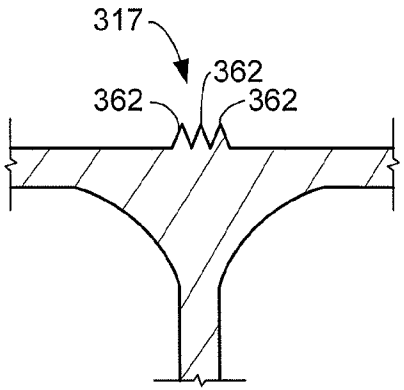
FIG. 17 is an enlarged detail view taken along detail view "H" of FIG. 16.

FIG. 17 is an enlarged detail view of the raised strips 317 of FIG. 16, taken along detail line "H" of FIG. 16. Although three (3) pointed protrusions 362 are illustrated in FIG. 17, more or fewer protrusions 362 could be employed in other embodiments. The pointed protrusions 362 offer the advantage of providing traction to the floor panels 128. In addition to the traction provided by the pointed protrusions 362 in the raised strips 317, the raised strips 317 may also be serrated in a direction longitudinal to the floor panels 128. For example, a knurler may be used on the surface of the raised strips 317 to serrate the raised strips 317. The serration (not shown) adds further traction to the floor panels 128.

Figure 18:
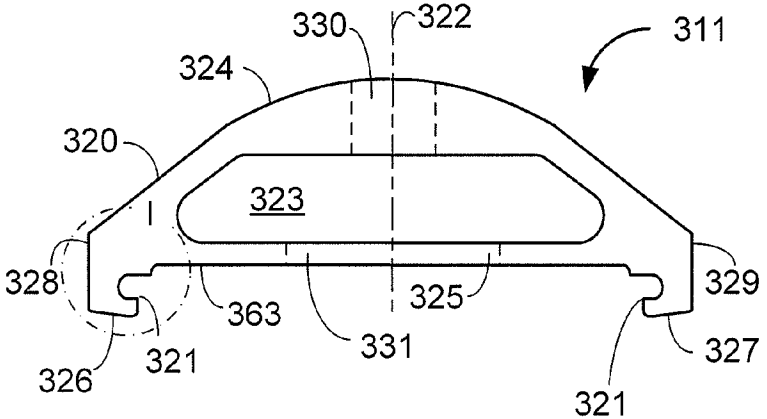
FIG. 18 is an end view of the body of the sliding bracket of FIG. 15.

FIG. 18 is an end view of the sliding bracket 311. The bracket comprises a one-piece body 320, which may be formed by extrusion or other suitable process. Extruded aluminum is used for the body 320 in one embodiment, but other materials suitably strong and rigid materials may be employed. The central portion 323 of the body 320 may be hollow as illustrated, to reduce weight and material and also to enclose the securement device 314 (FIG. 15) as discussed further herein.

In the illustrated embodiment, the body 320 is symmetrical and mirror-imaged about a plane running longitudinally through its vertical axis, illustrated in the two-dimensional representation of FIG. 18 as centerline 322. The body 320 is comprised of a curved top portion 324, middle support web 325, and left and right lower edges 326 and 327, respectively. Left and right lower edges 326 and 327 each comprise a concavely curved hook portion 321 that extends down the body 320 (i.e., in the direction of movement of the sliding bracket 311 (See FIG. 15)), as indicated by directional arrow 313 (FIG. 15).

Figure 20:
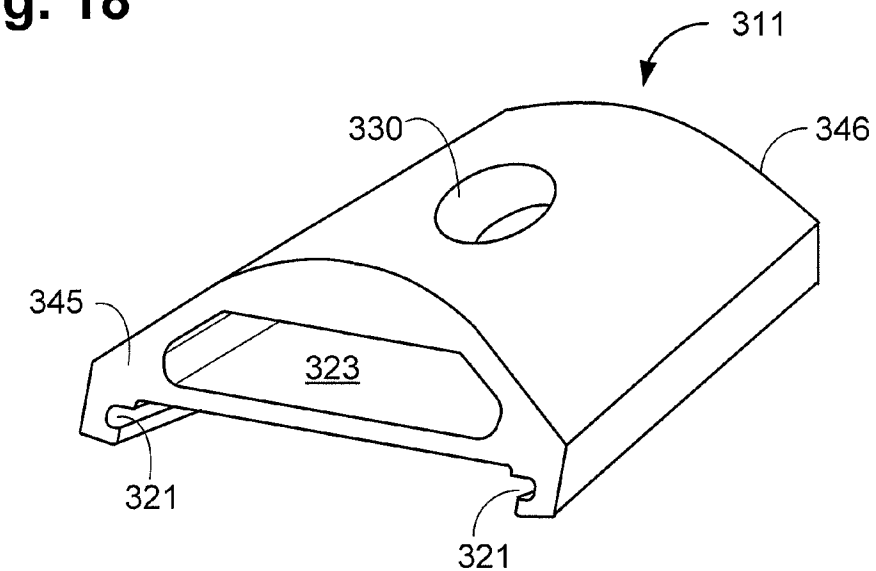
FIG. 20 is a front perspective view of the body of the sliding bracket of FIG. 15.

A top opening 330 extends between the top portion 324 of the body 320 and the central portion 323 of the body 320. The top opening 330, which in the illustrated embodiment is a cylindrical opening, retains the securement device 314 (FIG. 15). The top opening 330 is further illustrated in FIG. 20, a perspective view of the sliding bracket 311.

A middle support web 325 provides structural support for the body 320, and extends horizontally between a right side 328 and a left side 329 of the body 320. The middle support web 325 comprises a lower surface 363. The middle support web 325 further comprises access opening 331, which in the illustrated embodiment is a cylindrical opening. The access opening 331 permits access to the central portion 323 of the body 320 for installation of the securement device 314 (FIG. 15), as further discussed below.

Figure 19:
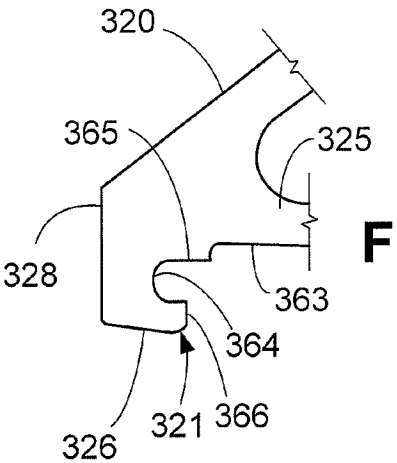
FIG. 19 is an enlarged detail view taken along detail view "I" of FIG. 18.

FIG. 19 is an enlarged detail view of the sliding claim 311 of FIG. 18, taken along detail line "I" of FIG. 19. In this embodiment, the hook portion 321 is comprised of generally C-shaped concavity 364 with a protruding lower lip 366. A ceiling surface 365 comprises the top portion of the "C" in the C-shaped concavity 365 and extends beyond the protruding lower lip 366. The lower surface 363 of the middle support web 325 is raised above the ceiling surface 365. The lower surface 363 is raised in this manner in order that the lower surface 363 remains clear of the raised track 317 (FIG. 15) between the channels 310 (FIG. 15) when the sliding bracket 311 is installed onto the floor panels 128.

The hook portion 321 illustrated is a C-shaped concavity 364 described herein so that it engages with the protrusion 312 (FIG. 15) on the floor panels 128 (FIG. 15). As would be contemplated by one of skill in the art, however, the shape of the concavity 364 and protrusion 312 could be modified somewhat without departing from the scope of the present invention, provided that the sliding bracket 311 be slideably engageable within the channels 310 of the floor panels 128 in the general manner described herein.

Figure 21:
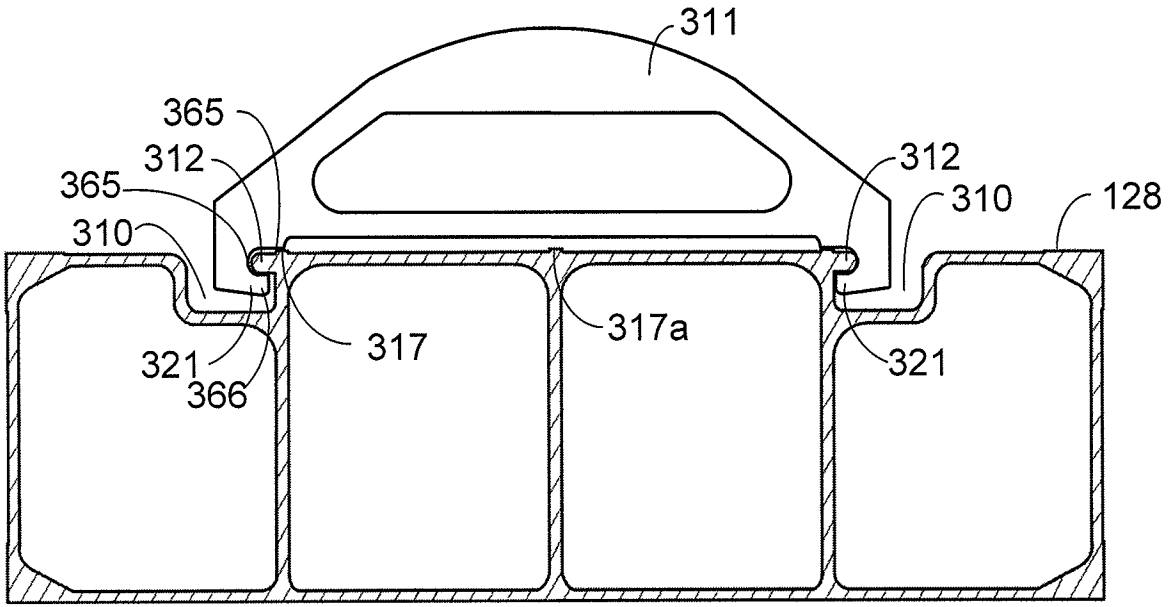
FIG. 21 is an enlarged cross sectional view of the floor panel of FIG. 15 showing an end view of the sliding bracket of FIG. 15 installed in the floor panel.

FIG. 21 is an enlarged cross-sectional view of a floor panel 128 shown with the sliding bracket 311 received by the channels 310. The hook portions 321 of the sliding bracket 311 engage with the protrusions 312 on the floor panel 128 to retain the sliding bracket 311 within the channels 310. In this regard, the protrusions 312 on the sliding bracket 311 are partially enclosed by the C-shaped concavity 365 of the hook portions 321. The ceiling surface 365 of the sliding bracket 311 slideably rests on the raised tracks 317 as illustrated. This configuration minimizes the sliding contact area between the sliding bracket 311 and the floor panel 128, so that the sliding contact area is limited to the raised tracks 317 and small portions of the ceiling surface 365. Once the bracket 311 is installed in the channel 310, the bracket 311 may slide longitudinally down the length of the floor panel 128 until it is in the desired position for securing a load (not shown).

Figure 22:
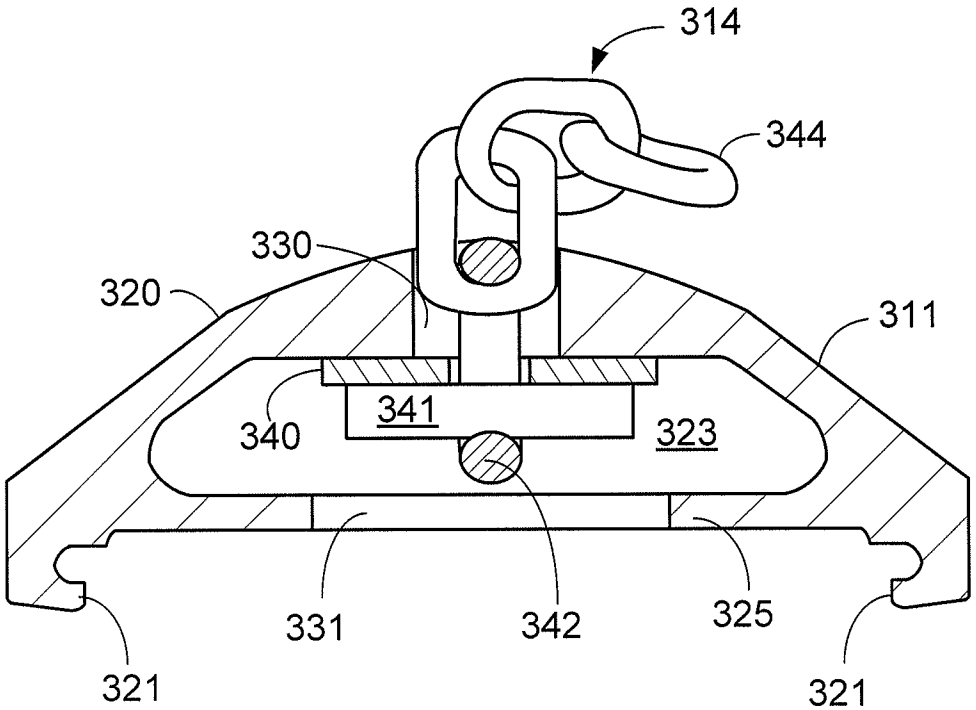
FIG. 22 is a cross sectional view of the sliding bracket of FIG. 15.

FIG. 22 is a sectional view of the sliding bracket 311, further illustrating one embodiment of the securement device 314. The securement device 314 comprises a short length of chain 344 that passes through the top opening 330 and into the central portion 323 of the body 320. A lowermost chain link 342 is passed through a washer 340, and then a cross bar 341 is passed through the central opening (not shown) of the lowermost chain link 342. The washer 340 is secured to the cross bar 341 by welding or some other suitable securement method, and the chain 344 is securely fixed to the washer 340/cross bar 341 combination.

The washer 340 may be a standard washer with an oblong-shaped hole (not shown) sized for receiving the lowermost chain link 342. The cross bar may be a solid cylindrical piece of material, for example, aluminum, suitable for passing through the lowermost chain link 342 and for being welded to the washer 340.

The access opening 331 provides access for the connection of the chain 344 to the washer 340 and cross bar 341. After the securement device 314 is installed into the sliding bracket 311, a plug (not shown) may be secured in the access opening 331. The plug may be a simple plastic or rubber plug, or any suitable plug known by one of skill in the art.

Note that the washer 340 is not fixedly secured to the body 320 of the sliding bracket 311 and the securement device 314 is thus not fixedly secured to the sliding bracket 311. Rather, the washer 340 is restrained within the central portion 323 of the body 320 by tension in the chain 344 when secured to a load (not shown). The securement device 314 may be removed from the sliding bracket 311 when the bracket 311 is not in use by removing the bracket 311 from the floor panel 128 and removing the securement device 314 from the bracket 311 through the access opening 331.

Figure 23:
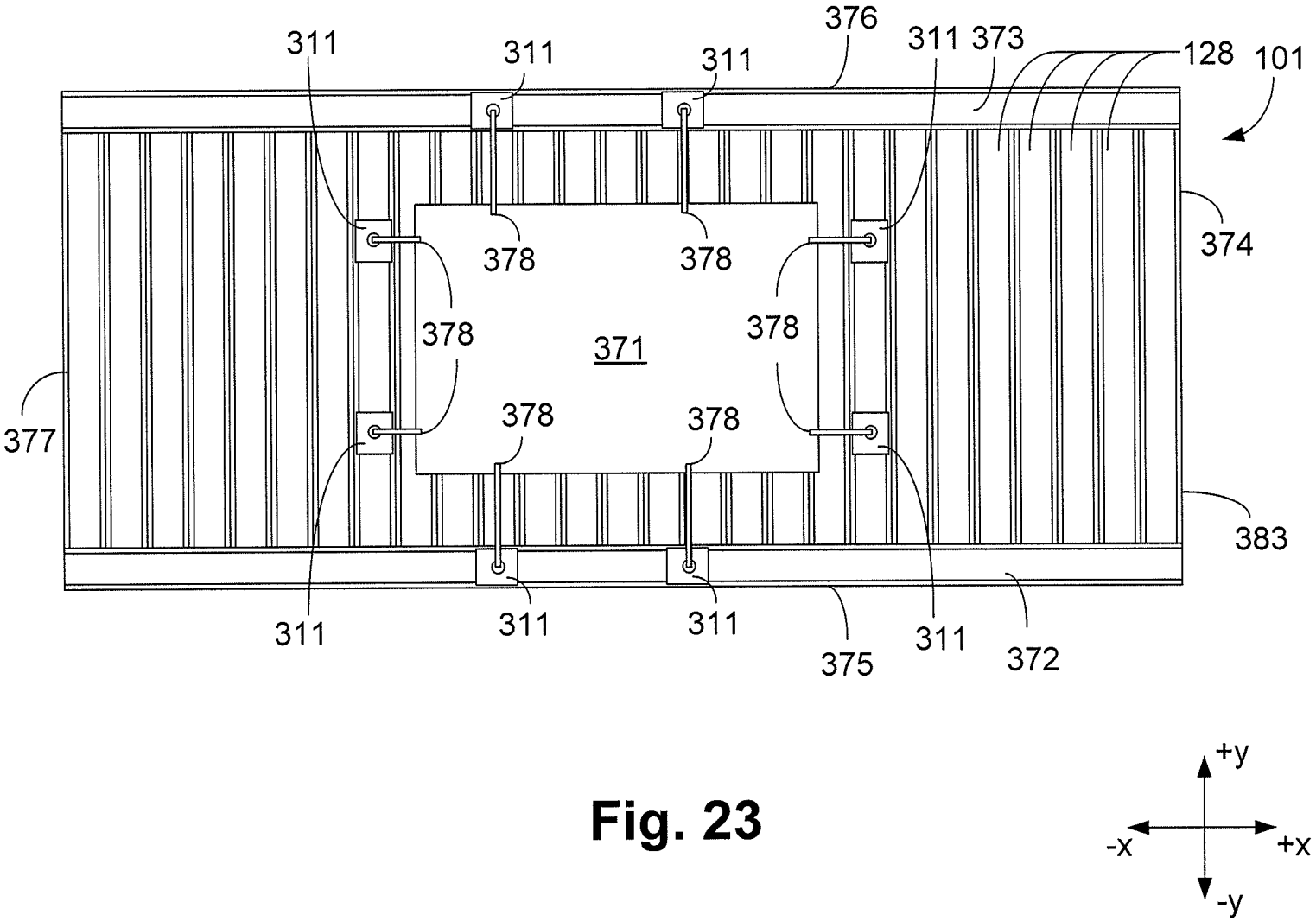
FIG. 23 is a top view of a floor showing a load secured by a load securement system according to an embodiment of the present disclosure.

FIG. 23 is a top plan view of a floor 101 according to an embodiment of the present disclosure, showing a load 371 disposed on the floor 101 and secured by chains or straps 378 which extend from the load 371 to the sliding brackets 311.

The floor 101 comprises a front edge 374, a rear edge 377, a right edge 375, and a left edge 376. The floor 101 comprises a right side floor panel 372 extending longitudinally along the length of the right side of the floor 101 (i.e., in the + and – y direction); a left side floor panel 373 extending longitudinally along the length of the left side of the floor 101; and a plurality of transverse floor panels 128 positioned generally perpendicularly to the right and left side floor panels 372 and 373.

In this embodiment, the right side floor panel 372 and left side floor panel 373 are substantially similar to the transverse floor panels 128, except that the floor panels 372 and 373 are disposed perpendicular to the floor panels 128 and thus extend longitudinally along the floor 101.

With the configuration described herein, although the sliding brackets 311 may slide in a direction longitudinal to the floor panels 128 (in the + and – y direction) such that they are easily repositionable along the floor panels 128, the sliding brackets 311 may not move in a direction transverse to the floor panels 128 (i.e. a direction longitudinal to the floor). This provides a very secure load securement system when chains or straps 378 apply a force in the transverse direction. The sliding brackets 311 may be positioned in virtually any location on the floor 101, and may thus secure a load 371 of virtually any size and shape.

What is claimed is:

1. A cargo deck comprising:

a floor engageable with a load, the floor comprising:

a plurality of extruded floor panels, each floor panel comprising an upper wall with two side edges, a front edge, and a rear edge;

a lower wall substantially parallel to the upper wall;

two side walls coextensive with the side edges and loser wall and extending substantially perpendicularly to the upper and lower walls;

a plurality of partitioning walls extending substantially perpendicularly to the upper and lower walls and substantially parallel to the side walls, wherein the partitioning walls, the upper wall, the lower wall, and the side walls define a plurality of tubular portions, the plurality of floor panels being welded to one another by adjacent side edges;

a plurality of longitudinally-extending support members engaging the floor, each support member comprising an upper portion positioned beneath and coupled to a lower surface of the lower wall, a web extending downwardly from the upper portion, and a lower flange extending transverse to the web, the plurality of floor panels oriented transversely to the longitudinally-extending support members so that the two side walls and the plurality of partitioning walls of each of the plurality of extruded floor panels are substantially perpendicular to longitudinal axes of the longitudinally-extending support members.

2. The deck of claim 1, further comprising a plurality of longitudinally extending support brackets, the support brackets each extending angularly from the lower surface of the lower will to one of the longitudinally-extending support members.

3. The deck of claim 2, wherein the floor and support brackets are comprised of extruded aluminum and the longitudinally-extending support members are comprised of steel.

4. The deck of claim 3, wherein each support bracket is substantially Y-shaped, with a substantially vertical portion having an upper flange welded to the lower surface of the lower wall, the upper flange comprising a channel that receives the upper portion of the longitudinally-extending support member.

5. The deck of claim 4, wherein an inward side of the web is rigidly affixed to the substantially vertical portion of the support bracket via an adhesive.

6. The deck of claim 4, further comprising an inward flange coplanar with the upper flange and welded to the lower surface of the lower wall, the inward flange coextensive with an angled support extending from the inward flange to a lower vertical support of the bracket.

7. The deck of claim 1, further comprising side rails disposed on opposed long sides of the deck.

8. The deck of claim 7, wherein the side rails are formed from extruded aluminum and each side rail comprises a floor section, an outer side rail wall integrally foamed as one piece with the floor section, and a rub rail integrally formed as one piece with the outer side rail wall, the rub rail extending outwardly from the outer side rail wall.

9. The deck of claim 1, further comprising:

a plurality of support posts, each of the plurality of support posts featuring:

a pair of leg portions, where each leg portion includes a bottom end portion and a top end portion;

said bottom end portions the pair of lea portions rotatably affixed to the longitudinally-extending support members; and a rigid crossbeam connecting the top end portions of the pair of leg portions, each support post pivotable between a deployed position where the pair of leg portions of each of the plurality of support posts are extending upwardly from opposed sides of the deck and a stowed position where each rigid cross beam is positioned, substantially adjacent to the floor.

10. A cargo deck comprising:

a floor engageable with a load, the floor comprising:

a plurality of extruded floor panels, each floor panel comprising an upper wall with two side edges, a front edge, and a rear edge;

a lower wall substantially parallel to the upper wall;

two side walls coextensive with the side edges and lower wall and extending substantially perpendicularly to the upper and lower walls;

a plurality of partitioning walls extending substantially perpendicularly to the upper and lower walls and substantially parallel to the side walls, wherein the partitioning walls, the upper wall, the lower wall, and the side walls define a plurality of tubular portions, the plurality of floor panels being welded to one another by adjacent side edges;

a pair of longitudinally-extending support brackets, each support bracket positioned beneath and welded directly to a lower surface of the lower wall;

a pair of longitudinally-extending support members, each support member comprising an upper portion rigidly affixed to the support bracket via adhesive, each support member further comprising a web extending downwardly from the upper portion and a lower flange extending transverse to the web.

11. The deck of claim 10, wherein the floor and support brackets are comprised of extruded aluminum and the longitudinally-extending support members are comprised of steel.

12. The deck of claim 11, wherein each support bracket is substantially Y-shaped, with a substantially vertical portion having an upper flange welded directly to the lower surface of the lower wall, the upper flange comprising a channel that receives the upper portion of the longitudinally-extending support member.

13. The deck of claim 12, wherein an inward side of the web is rigidly affixed to the substantially vertical portion of the support bracket via an adhesive.

14. The deck of claim 12, further comprising an inward flange coplanar with the upper flange and welded directly to the lower surface of the lower wall, the inward flange coextensive with an angled support extending from the inward flange to a lower vertical support of the bracket.

15. The deck of claim 10, further comprising side rails disposed on opposed long sides of the deck.

16. The deck of claim 15, wherein the side rails are formed from extruded aluminum and each side rail comprises a floor section, an outer side rail wall integrally formed as one piece with the floor section, and a rub rail integrally formed as one piece with the outer side rail wall, the rub rail extending outwardly from the outer side rail wall.

17. The deck of claim 10, further comprising:

a plurality of support posts, each of the plurality of support posts featuring:

a pair of leg portions, where each leg portion includes a bottom end portion and a top end portion;

said bottom end portions the pair of leg portions rotatably affixed to the longitudinally-extending support members; and a rigid crossbeam connecting the top end portions of the pair of leg portions, each support post pivotable between a deployed position where the pair of leg portions of each of the plurality of support posts are extending upwardly from opposed sides of the deck and a stowed position where each rigid cross beam is positioned substantially adjacent to the floor.

* * * * *